US012708163B2

(12) United States Patent
Jones

(10) Patent No.: US 12,708,163 B2
(45) Date of Patent: Aug. 18, 2026

(54) PROTECTIVE COVERING FOR A HAT

(71) Applicant: Albert Lorenzo Jones, Thornton, CO (US)

(72) Inventor: Albert Lorenzo Jones, Thornton, CO (US)

( * ) Notice: Subject to any disclaimer, the term of this patent is extended or adjusted under 35 U.S.C. 154(b) by 0 days.

(21) Appl. No.: 19/040,576

(22) Filed: Jan. 29, 2025

(65) Prior Publication Data

US 2025/0221484 A1 Jul. 10, 2025

Related U.S. Application Data

(63) Continuation-in-part of application No. 29/907,854, filed on Jan. 9, 2024.

(60) Provisional application No. 63/626,303, filed on Jan. 29, 2024.

(51) Int. Cl.
*A42B 1/18* (2006.01)

(52) U.S. Cl.
CPC ..... *A42B 1/18* (2013.01)

(58) Field of Classification Search
CPC ..... A42B 1/18; A42B 3/003; A42B 1/002; A42B 1/012
See application file for complete search history.

(56) References Cited

U.S. PATENT DOCUMENTS 1,330,582 A 2/1920 Daniels
2,176,953 A * 10/1939 Bloom ..... A42B 1/18 2/175.6
2,424,414 A * 7/1947 Oppenheimer ..... A42B 1/18 2/175.6
2,655,256 A * 10/1953 Guest ..... A42B 1/18 206/8
2,677,457 A * 5/1954 Guest ..... A42B 1/18 206/8
2,734,197 A * 2/1956 Kreinik ..... A42B 1/18 2/195.1

(Continued)

FOREIGN PATENT DOCUMENTS

KR 102059123 2/2020

OTHER PUBLICATIONS

English Translation from Google Patents for KR102059123 cited above.

(Continued)

*Primary Examiner* — Alissa L Hoey
(74) *Attorney, Agent, or Firm* — Trenner Law Firm, LLC; Mark Trenner

(57) ABSTRACT

A protective covering is provided as it may be used for a hat. An example of the covering includes a crown receiving portion and a bill receiving portion. The crown receiving portion forms a domed cavity to cover the crown of a hat, while the bill receiving portion includes a pocket to receive and protect the hat's bill. An example material of manufacture may be clear polyvinyl chloride (PVC), ensuring visibility of the hat while providing waterproof protection against weather and environmental damage. A drawstring tightening mechanism allows for adjustable securement, ensuring the covering remains in place during use. The covering enables a user to protect their hat from water, dirt, and weather conditions while the hat is either on display or being worn.

11 Claims, 6 Drawing Sheets

(56) References Cited

U.S. PATENT DOCUMENTS

| | | | | | |
|---|---|---|---|---|---|
| 3,166,766 | A * | 1/1965 | Banello, Jr. | A42B 1/18 | 2/209.13 |
| 3,201,802 | A * | 8/1965 | Smith | A42B 1/18 | 2/46 |
| 3,469,264 | A * | 9/1969 | Harris | A42B 1/06 | 2/172 |
| 4,165,542 | A * | 8/1979 | Mclaughlin | A42B 1/201 | 2/175.1 |
| 4,378,606 | A * | 4/1983 | Snowden | A42B 1/041 | 2/200.1 |
| 5,003,639 | A * | 4/1991 | White | A42B 1/18 | 40/329 |
| D337,645 | S | 7/1993 | Guziejka | | |
| D363,812 | S | 11/1995 | Cassady | | |
| 5,488,740 | A * | 2/1996 | Garza | A42B 1/22 | 2/195.3 |
| 5,592,696 | A * | 1/1997 | Oliver | A42C 5/00 | 2/175.6 |
| 5,669,075 | A | 9/1997 | Weeks | | |
| 5,694,648 | A | 12/1997 | Nucifora | | |
| D402,088 | S | 12/1998 | Edwards | | |
| D402,791 | S | 12/1998 | Mishal | | |
| D404,186 | S | 1/1999 | Bellon | | |
| 6,012,172 | A * | 1/2000 | Steffy | A42B 1/02 | 2/175.1 |
| D420,493 | S | 2/2000 | Blake | | |
| D421,519 | S | 3/2000 | Secrest | | |
| 6,052,830 | A * | 4/2000 | Payne | A42B 1/045 | 2/171.1 |
| 6,061,836 | A * | 5/2000 | Peters | A42B 3/003 | 2/8.1 |
| 6,081,933 | A * | 7/2000 | Partsch, IV | A42B 3/227 | 2/422 |
| 6,163,886 | A | 12/2000 | Carter | | |
| 6,237,162 | B1 * | 5/2001 | Gill | A42B 3/227 | 2/10 |
| 6,848,122 | B1 * | 2/2005 | Meeds | A42B 3/003 | 2/175.6 |
| 7,310,829 | B1 | 12/2007 | Engel-Wilson | | |
| D591,485 | S | 5/2009 | Cho | | |
| D599,533 | S | 9/2009 | Yun | | |
| D618,446 | S | 6/2010 | Clare et al. | | |
| 7,784,113 | B2 * | 8/2010 | Ragan | A41D 19/02 | 2/164 |
| 7,971,278 | B2 * | 7/2011 | Klamerus, Jr. | A42B 1/18 | 2/172 |
| 8,479,319 | B1 * | 7/2013 | Erhardt | A42B 1/206 | 2/172 |
| D717,024 | S | 11/2014 | Hines et al. | | |
| D729,501 | S | 5/2015 | Abel | | |
| 9,427,038 | B2 * | 8/2016 | Bundy | A42B 1/006 | |
| D779,168 | S | 2/2017 | Arenson et al. | | |
| D802,892 | S | 11/2017 | Jiyong | | |
| D816,305 | S | 5/2018 | Blankenbaker | | |
| 9,968,498 | B2 * | 5/2018 | Field | A61F 13/622 | |
| 9,993,042 | B1 * | 6/2018 | Miller | A42B 1/048 | |
| 10,051,907 | B2 * | 8/2018 | Dammann | A42B 1/12 | |
| 10,842,215 | B2 * | 11/2020 | Woods | A42B 1/18 | |
| 11,547,880 | B2 * | 1/2023 | Oliver, III | A41D 13/1153 | |
| 11,571,035 | B2 * | 2/2023 | Bonhomme | A42C 1/00 | |
| 11,576,453 | B2 * | 2/2023 | Sunseri | A42B 1/22 | |
| 11,627,775 | B1 * | 4/2023 | Devine | A42B 3/227 | 2/15 |
| D1,039,245 | S | 8/2024 | Devlin | | |
| D1,055,460 | S | 12/2024 | Vasquez | | |
| D1,081,078 | S | 7/2025 | Yoo et al. | | |
| 2005/0246825 | A1 * | 11/2005 | Ruhl | A42B 1/18 | 2/422 |
| 2006/0168709 | A1 * | 8/2006 | Rattay | A42B 1/22 | 2/183 |
| 2007/0000026 | A1 | 1/2007 | Carr | | |
| 2008/0222782 | A1 * | 9/2008 | Stokes | A42B 3/003 | 2/422 |
| 2011/0145977 | A1 * | 6/2011 | Oates | A42B 1/18 | 2/175.1 |
| 2011/0252545 | A1 * | 10/2011 | Irrgang | A42B 3/003 | 428/44 |
| 2013/0047323 | A1 * | 2/2013 | Ireland | A42B 3/003 | 2/422 |
| 2013/0312156 | A1 | 11/2013 | Dean | | |
| 2015/0047098 | A1 * | 2/2015 | Pickett | A42B 1/18 | 2/181 |
| 2017/0156432 | A1 * | 6/2017 | Gratacos, Jr. | A42B 1/18 | |
| 2018/0116325 | A1 * | 5/2018 | Woods | A42B 1/24 | |
| 2018/0168264 | A1 * | 6/2018 | Watkins | A42B 1/18 | |
| 2018/0220728 | A1 * | 8/2018 | McDade | A42B 1/201 | |
| 2025/0049161 | A1 * | 2/2025 | Finnell | A42B 1/205 | |

OTHER PUBLICATIONS

Co-owned priority U.S. Appl. No. 29/907,854 filed Jan. 29, 2025 for "Hat Protector" of Albert Lorenzo Jones. Copies not attached, but Applicant believes that the Examiner can access the file history via the USPTO internal systems.

* cited by examiner

PROTECTIVE COVERING FOR A HAT

FIELD OF THE INVENTION

The present invention relates generally to headwear. More specifically, the present invention is a protective covering for both storing a hat and enabling a user to wear a hat while preventing the hat from damage caused by weather, dust, and debris.

BACKGROUND OF THE INVENTION

Hats are widely used by individuals for both functional and aesthetic purposes. They provide protection from the elements, such as the sun and rain, while also serving as a personal style statement. Hats can range from casual baseball caps to high-end fashion pieces or collectible items. Given the versatility and popularity of hats, users often seek ways to preserve their appearance and condition, especially in situations where they are exposed to harsh weather conditions.

Historically, numerous inventions and methods have been devised to protect hats. For example, hat storage cases and boxes are commonly used to safeguard hats from dust, dirt, and damage while in storage or during travel. These cases typically feature rigid or semi-rigid structures that ensure the hat retains its shape and is protected from external forces. However, these solutions are limited to times when the hat is not being worn and fail to address the need for protection during actual use.

Other approaches to protecting hats involve covering the user rather than the hat itself. Rain ponchos, hooded jackets, and umbrellas shield the wearer and their hat from rain, but they do not specifically protect the hat. Furthermore, these solutions often fail to fully enclose the hat, leaving it vulnerable to water damage, dirt, and other environmental factors. This is particularly problematic for hats made of sensitive or expensive materials, such as felt, wool, or leather, which can be irreparably damaged by moisture or stains.

Additionally, certain prior art involves waterproofing sprays and coatings designed to create a barrier on the surface of the hat. While these products can provide a measure of protection, they are not always effective against prolonged exposure to water or extreme weather conditions. Moreover, the application of such sprays may alter the appearance, texture, or integrity of the hat material, making them less appealing for high-quality or collectible hats.

The lack of a solution that combines full protection with simultaneous wearability underscores the need for an improved design. Consumers, particularly those who own high-end or sentimental hats, require a product that offers robust protection from water, dirt, and weather while maintaining the appearance and visibility of the hat.

The present invention addresses this gap by introducing a protective covering for a hat comprising a crown receiving portion and a bill receiving portion. The crown receiving portion forms a domed cavity that snugly fits over the crown of the hat, while the bill receiving portion includes a pocket designed to securely hold the bill. Unlike prior art, this design allows the user to wear the hat normally while ensuring full protection from environmental factors. The inclusion of a clear polyvinyl chloride (PVC) material ensures the hat remains visible, preserving its aesthetic value during use. Additionally, the adjustable drawstring tightening mechanism provides a secure fit, preventing the protective covering from slipping or being dislodged during wear.

To date, no existing invention combines the functionality of protecting a hat from water and weather with the ability to wear the hat simultaneously. The protective covering for a hat described herein represents a novel advancement in the field, offering an elegant and practical solution for hat protection that aligns with both functional and aesthetic needs.

DETAIL DESCRIPTIONS OF THE INVENTION

Figure 1:
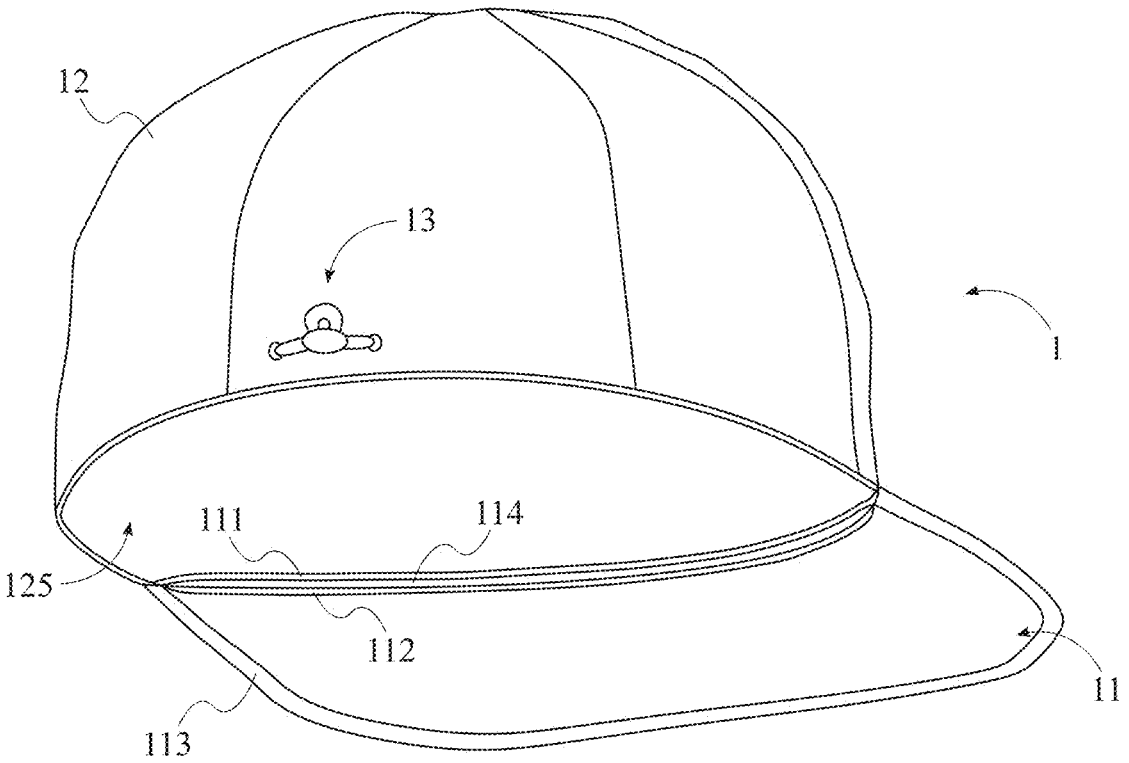
FIG. 1 is a rear-bottom perspective view of the present invention.

All illustrations of the drawings are for the purpose of describing selected versions of the present invention and are not intended to limit the scope of the present invention.

As a preliminary matter, it will readily be understood by one having ordinary skill in the relevant art that the present disclosure has broad utility and application. As should be understood, any embodiment may incorporate only one or a plurality of the above-disclosed aspects of the disclosure and may further incorporate only one or a plurality of the above-disclosed features. Furthermore, any embodiment discussed and identified as being "preferred" is considered to be part of a best mode contemplated for carrying out the embodiments of the present disclosure. Other embodiments also may be discussed for additional illustrative purposes in providing a full and enabling disclosure. Moreover, many embodiments, such as adaptations, variations, modifications, and equivalent arrangements, will be implicitly disclosed by the embodiments described herein and fall within the scope of the present disclosure.

Accordingly, while embodiments are described herein in detail in relation to one or more embodiments, it is to be understood that this disclosure is illustrative and exemplary of the present disclosure, and are made merely for the purposes of providing a full and enabling disclosure. The detailed disclosure herein of one or more embodiments is not intended, nor is to be construed, to limit the scope of patent protection afforded in any claim of a patent issuing here from, which scope is to be defined by the claims and the equivalents thereof. It is not intended that the scope of patent protection be defined by reading into any claim a limitation found herein that does not explicitly appear in the claim itself.

Additionally, it is important to note that each term used herein refers to that which an ordinary artisan would understand such term to mean based on the contextual use of such term herein. To the extent that the meaning of a term used herein—as understood by the ordinary artisan based on the contextual use of such term—differs in any way from any particular dictionary definition of such term, it is intended that the meaning of the term as understood by the ordinary artisan should prevail.

Furthermore, it is important to note that, as used herein, "a" and "an" each generally denotes "at least one," but does not exclude a plurality unless the contextual use dictates otherwise. When used herein to join a list of items, "or" denotes "at least one of the items," but does not exclude a plurality of items of the list. Finally, when used herein to join a list of items, "and" denotes "all of the items of the list."

The following detailed description refers to the accompanying drawings. Wherever possible, the same reference numbers are used in the drawings and the following description to refer to the same or similar elements. While many embodiments of the disclosure may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the disclosure. Instead, the proper scope of the disclosure is defined by the appended claims. The present disclosure contains headers. It should be understood that these headers are used as references and are not to be construed as limiting upon the subjected matter disclosed under the header.

Other technical advantages may become readily apparent to one of ordinary skill in the art after review of the following figures and description. It should be understood at the outset that, although exemplary embodiments are illustrated in the figures and described below, the principles of the present disclosure may be implemented using any number of techniques, whether currently known or not. The present disclosure should in no way be limited to the exemplary implementations and techniques illustrated in the drawings and described below.

Unless otherwise indicated, the drawings are intended to be read together with the specification, and are to be considered a portion of the entire written description of this invention. As used in the following description, the terms "horizontal", "vertical", "left", "right", "up", "down" and the like, as well as adjectival and adverbial derivatives thereof (e.g., "horizontally", "rightwardly", "upwardly", "radially", etc.), simply refer to the orientation of the illustrated structure as the particular drawing figure faces the reader. Similarly, the terms "inwardly," "outwardly" and "radially" generally refer to the orientation of a surface relative to its axis of elongation, or axis of rotation, as appropriate.

The present disclosure includes many aspects and features. Moreover, while many aspects and features relate to, and are described in the context of a protective covering for a hat 1, embodiments of the present disclosure are not limited to use only in this context.

Figure 2:
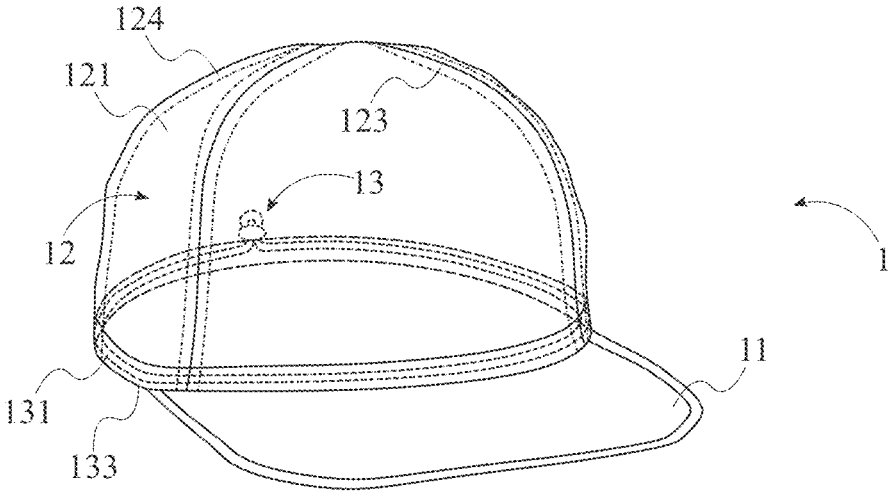
FIG. 2 is a front perspective view of the present invention.

As shown in FIG. 1 and FIG. 2, the present invention is a protective covering for a hat 1 comprising a bill receiving portion 11, a crown receiving portion 12, and a tightening mechanism 13. In the context of the present invention, the bill receiving portion 11 extends outwardly from the crown receiving portion 12. Furthermore, in the context of the present invention, the crown receiving portion 12 is approximately circular, thus comprising a circumference (i.e. a size), wherein the tightening mechanism 13 adjustably manipulates the circumferential size of the crown receiving portion 12.

In the preferred embodiment of the present invention, the bill receiving portion 11, as shown in FIG. 1, comprises a plurality of panels including a first panel 111 and a second panel 112, wherein said panels 111,112 compose a pocket 114 comprising an opening. In the preferred embodiment, the first panel 111 and the second panel 112 are coupled together about the distal edges (i.e. the outermost edges), by a seam 113, such that the seam is a waterproof seam traversing the outermost edges of the first panel 111 and the second panel 112, thus forming a waterproof pocket 114; thus preventing water from permeating into the pocket 114 from an extrinsic source.

Furthermore, in the preferred embodiment of the present invention, the crown receiving portion 12, as shown in FIG. 2, comprises a plurality of panels 121 wherein said plurality of panels 121 are configured to form a domed cavity 125 (shown in FIG. 1). In the preferred embodiment of the present invention, the plurality of panels comprises five panels such that the frontmost panel is unimpeded by a scam, thus providing full visibility to a frontmost portion of a hat. In the preferred embodiment of the present invention, the plurality of panels 121 are coupled together by stitching 123 wherein said stitching 123 couples adjacent panels. In the preferred embodiment of the present invention, the stitching 123 is covered by a waterproof sealant 124, thus preventing water from permeating the domed cavity 125 through the stitching. In some embodiments of the present invention, the waterproof sealant 124 is a tape that is applied over the stitching 123, thus preventing water from permeating the stitching 123. In the context of the present invention, the opening of the pocket 114 of the bill receiving portion 11 opens towards the domed cavity.

Figure 3:
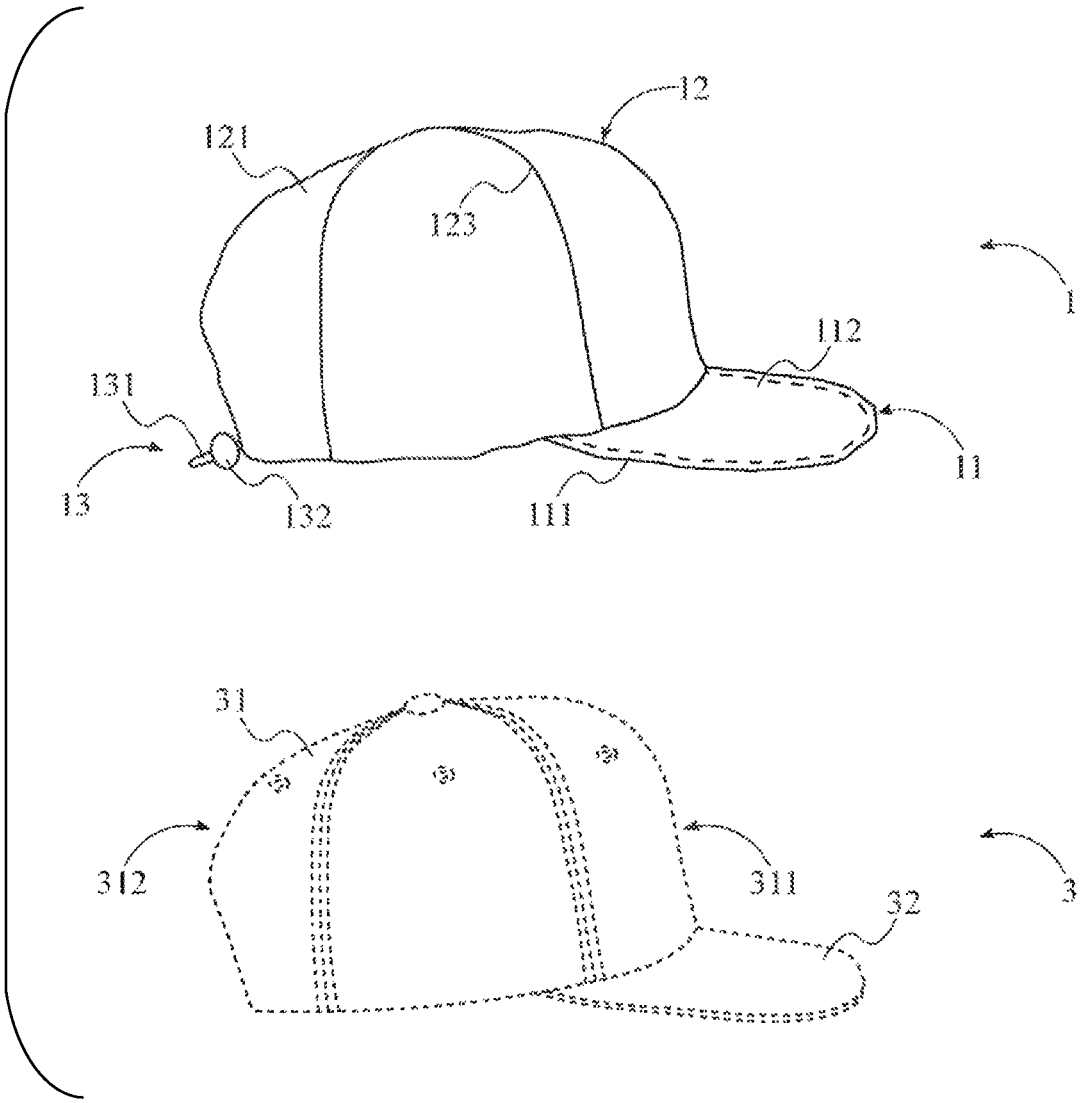
FIG. 3 is a side exploded view of the present invention and a hat.

Additionally, as shown in FIG. 2 and FIG. 3, in the preferred embodiment of the present invention, the tightening mechanism comprises a drawstring 131, a locking member 132, and a sleeve 133. In the context of the present invention, the sleeve 133 traverses the bottom most edge portion of the crown receiving portion 12. Furthermore, within the context of the present invention, the drawstring 131 traverses the sleeve 133 such that pulling the drawstring 131, reduces the circumferential size of the sleeve 133, and thus the circumferential size of the crown receiving portion 12. The locking member 132, within the context of the present invention, is a mechanism that enables a user to selectively secure the drawstring 131 at a select circumferential size. In the preferred embodiment of the present invention, the locking mechanism 132 is a spring cord lock wherein the drawstring 131 is pulled through the locking mechanism 132, and said locking mechanism 132 adjustably locks onto the drawstring 131, thereby enabling a user to selectively adjust the circumferential size of the crown receiving portion 12.

Figure 4:
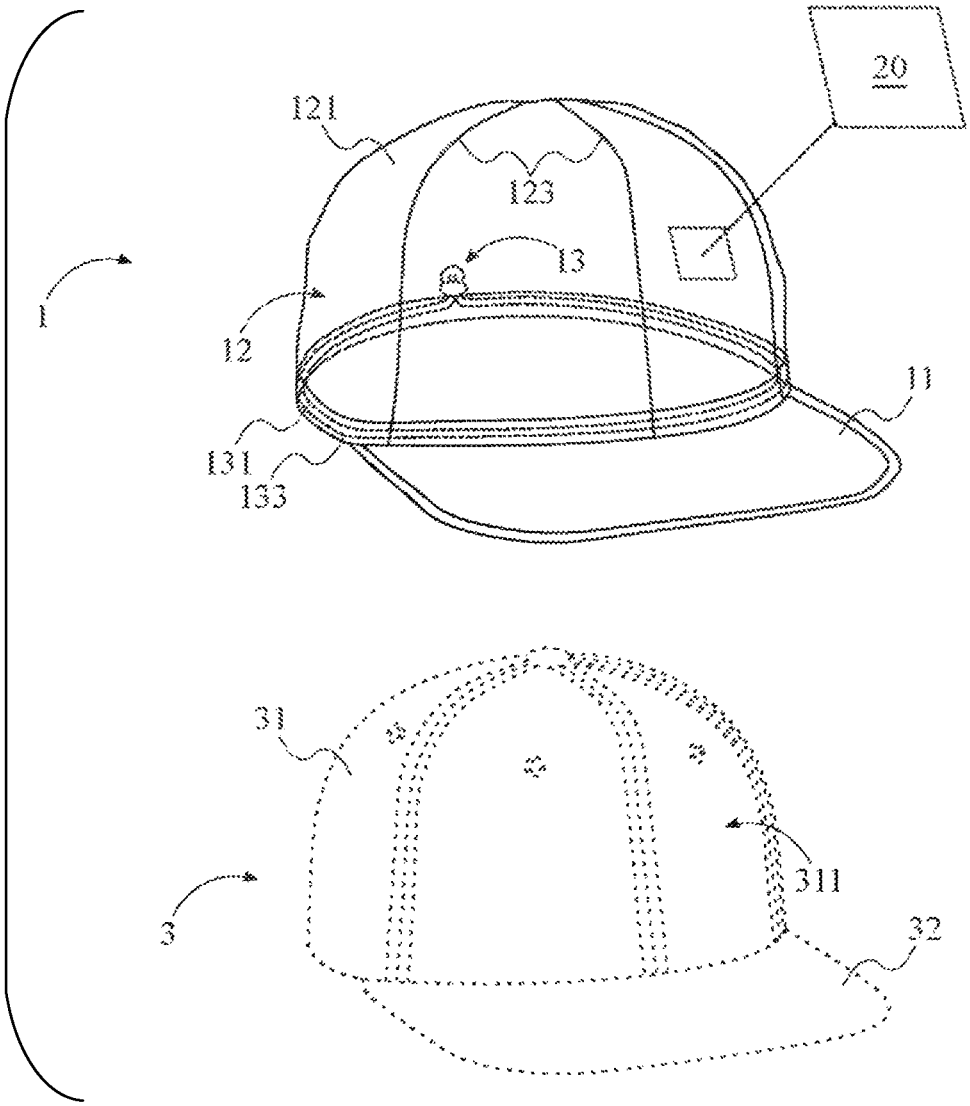
FIG. 4 is an exploded perspective view of the present invention and a hat.

As shown in FIG. 4, in the preferred embodiment, the present invention, including the bill receiving portion 11 and the crown receiving portion 12 are composed of a water impermeable material 20. In some embodiments of the present invention, the bill receiving portion and the crown receiving portion are composed of polyvinyl chloride. In the preferred embodiment of the present invention, the material 20 is a clear material, thereby enabling a hat to be visible while the present invention is secured to the hat.

Figure 5:
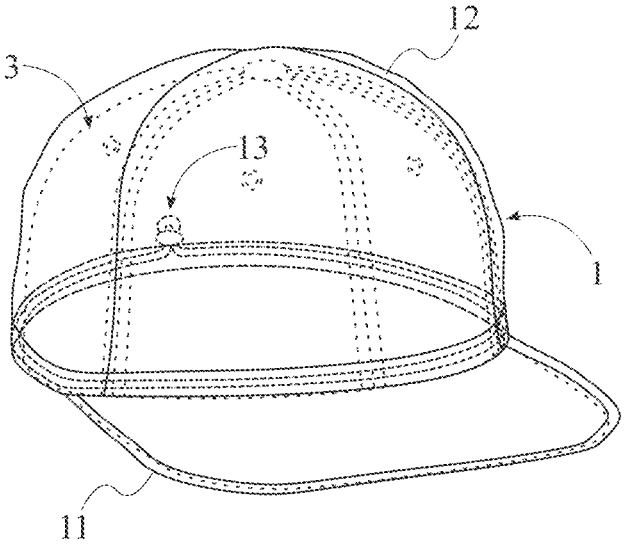
FIG. 5 is a front perspective view of the present invention covering a hat.
Figure 6:
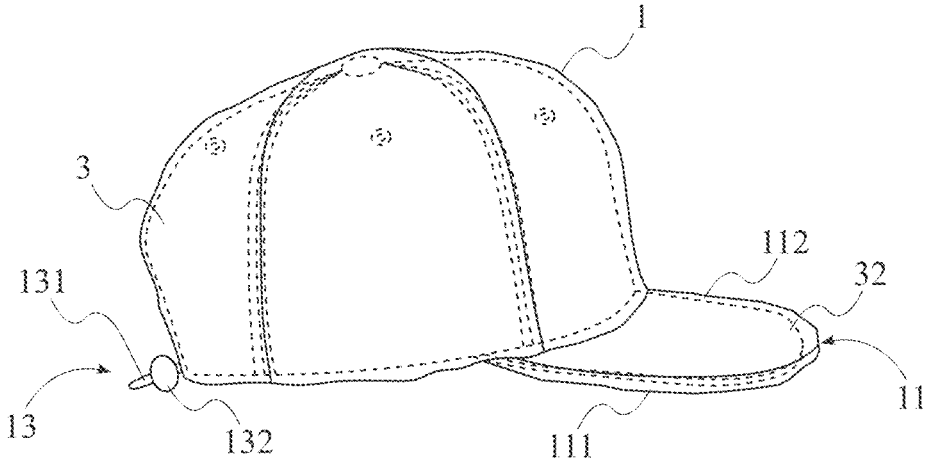
FIG. 6 is a side view of the present invention covering a hat.

As shown in FIG. 4, FIG. 5, and FIG. 6, the protective covering for a hat 1 removably couples to a hat. In the context of the present invention, the hat 3 is a cap comprising a crown 31 and a bill 32, wherein the bill 32 extends from a front portion 311 of the crown 31. In the preferred embodiment, the hat 3 further comprises a rear portion 312 wherein said rear portion 312 is opposite the front portion 311 of the crown 31.

Further regarding FIG. 5 and FIG. 6, in the preferred embodiment of the present invention, the crown 31 of the hat 3 is received by the crown portion 12 of the present invention and the bill 32 of the hat 3 is removably inserted into the pocket 14 of the bill receiving portion 11, such that the bill 32 of the hat 3 is interposed between the first panel 111 and the second panel 112 of said bill receiving portion 11. Furthermore, in the preferred embodiment of the present invention, the tightening mechanism 13 is proximate the portion of the present invention that engages within the rear portion 312 of the hat 3. In the preferred embodiment of the present invention, the crown 31 of the hat 3 is unimpeded by the protective covering for a hat 1, such that a user may wear the hat 3 while utilizing the present invention.

Although the invention has been explained in relation to its preferred embodiment, it is to be understood that many other possible modifications and variations can be made without departing from the spirit and scope of the invention.

What is claimed is:

1. A protective covering for a hat comprising:
a bill receiving portion;
a crown receiving portion; and
a tightening mechanism;
wherein the bill receiving portion is configured as a pocket extending outwardly from the crown receiving portion;
wherein the tightening mechanism adjustably manipulates a circumferential size of the crown receiving portion;
wherein the tightening mechanism comprises a drawstring, a sleeve, and a locking member, wherein the sleeve traverses the bottom most portion of the crown receiving portion, the drawstring traverses the sleeve, and the locking member secures the drawstring at a selected circumferential size; and
wherein the crown receiving portion comprises a plurality of panels coupled together by stitching, and the stitching is covered with a waterproof sealant such that the waterproof sealant prevents water from permeating a domed cavity composed by the crown receiving portion.

2. The protective covering for a hat, as claimed in claim 1, wherein the bill receiving portion comprises:
a first panel; and
a second panel;
wherein the first panel and the second panel are coupled together by a seam which traverses about distal edges of the first panel and the second panel such that a pocket is composed;
wherein the pocket comprising an open end; and
wherein the open end of the pocket opens into a domed cavity composed by the crown receiving portion.

3. The protective covering for a hat, as claimed in claim 1, wherein the crown receiving portion and the bill receiving portion are composed of polyvinyl chloride.

4. The protective covering for a hat, as claimed in claim 1, wherein the crown receiving portion and the bill receiving portion are composed of clear polyvinyl chloride.

5. The protective covering for a hat, as claimed in claim 1, wherein the pocket receives a bill of the hat and the domed cavity is sized to receive a crown of the hat.

6. The protective covering for a hat, as claimed in claim 1, wherein the plurality of panels of the crown receiving portion comprises five panels, wherein a frontmost panel of the five panels is unimpeded by a seam to provide visibility to a frontmost portion of the hat.

7. The protective covering for a hat, as claimed in claim 1, wherein the waterproof sealant is a tape applied over the stitching.

8. A protective covering for a hat comprising:
a bill receiving portion;
a crown receiving portion; and
a tightening mechanism;
wherein the crown receiving portion and the bill receiving portion are composed of clear polyvinyl chloride;
wherein the crown receiving portion comprises a plurality of panels coupled together by stitching, and the stitching is covered with a waterproof sealant such that the waterproof sealant prevents water from permeating a domed cavity composed by the crown receiving portion;
wherein the bill receiving portion is configured as being a pocket extending outwardly from the crown receiving portion; and
wherein the tightening mechanism comprises a drawstring, a sleeve, and a locking member, wherein the sleeve traverses the bottom most portion of the crown receiving portion, the drawstring traverses the sleeve for selecting a circumferential size of the crown receiving portion, and the locking member secures the drawstring at the selected circumferential size of the crown receiving portion.

9. The protective covering for a hat, as claimed in claim 8, wherein the bill receiving portion further comprises:
a first panel; and
a second panel;
wherein the first panel and the second panel are coupled about distal edges of the first panel and the second panel, composing a pocket; and
wherein the pocket opens into the domed cavity of the crown receiving portion.

10. A protective covering for a hat comprising:
a bill receiving portion;
a crown receiving portion; and
a tightening mechanism;
wherein the crown receiving portion comprising a plurality of panels;
the plurality of panels composes a domed cavity;
wherein the bill receiving portion being a pocket that extends outwardly from the crown receiving portion;
wherein the tightening mechanism traverses a bottom most portion of the crown receiving portion;
wherein the tightening mechanism adjustably manipulates a circumferential size of the crown receiving portion;
wherein the bill receiving portion and the crown receiving portion are composed of polyvinyl chloride;
wherein the tightening mechanism comprises:
a drawstring;
a locking member; and
a sleeve;
wherein sleeve traverses the bottom most portion of the crown receiving portion;
wherein the drawstring traverses the sleeve such that pulling the drawstring through the sleeve manipulates a circumferential size of the crown receiving portion; and
wherein the locking member couples to the drawstring such that the locking member secures the circumferential size of the crown receiving portion;
wherein the bill receiving portion comprises:
a first panel; and
a second panel;
wherein first panel and the second panel are coupled together by a seam which traverses about distal edges of the first panel and second panel such that a pocket is composed;
wherein the pocket comprises an open end; and wherein the open end of the pocket opens into a domed cavity composed by the crown receiving portion.

11. The protective covering for a hat, as claimed in claim 10, wherein the seam traversing about distal edges of the first panel and the second panel is a waterproof seam configured to prevent water from permeating into the pocket.

* * * * *